US008925749B2

(12) United States Patent
Laperriere et al.

(10) Patent No.: US 8,925,749 B2
(45) Date of Patent: Jan. 6, 2015

(54) STORAGE CONTAINER FOR ELECTRICAL COMPONENTS

(75) Inventors: Sarah Laperriere, Hampstead, NH (US); Michael Rzasa, Nashua, NH (US); Armand Montminy, Hooksett, NH (US); Rodd Ruland, Amherst, NH (US)

(73) Assignee: Hubbell Incorporated, Shelton, CT (US)

( * ) Notice: Subject to any disclaimer, the term of this patent is extended or adjusted under 35 U.S.C. 154(b) by 624 days.

(21) Appl. No.: 13/117,342

(22) Filed: May 27, 2011

(65) Prior Publication Data

US 2012/0298671 A1 Nov. 29, 2012

(51) Int. Cl.

*B65D 41/06* (2006.01)
*B65D 41/56* (2006.01)
*B65D 51/24* (2006.01)

(52) U.S. Cl.

CPC ..... *B65D 41/06* (2013.01); *B65D 41/56* (2013.01); *B65D 51/242* (2013.01)
USPC ..... 215/332; 220/3.8; 220/3.9; 220/744; 220/751; 220/379; 206/701

(58) Field of Classification Search

CPC ..... B65D 41/06; B65D 41/56; B65D 51/242
USPC ..... 220/379, 3.2, 3.8, 3.9, 744, 694, 751, 220/756, 735; 206/701, 702, 703
See application file for complete search history.

(56) References Cited

U.S. PATENT DOCUMENTS

| | | | | |
|---|---|---|---|---|
| 1,184,881 | A | 5/1916 | Schumacher | |
| 2,069,048 | A | 1/1937 | Rehberger | |
| 4,019,638 | A * | 4/1977 | Miller | 211/74 |
| 4,898,295 | A * | 2/1990 | Kim | 220/613 |
| 4,992,910 | A | 2/1991 | Evans | |
| 5,464,110 | A | 11/1995 | Heyworth | |
| 5,749,486 | A | 5/1998 | Porter | |
| 6,015,061 | A | 1/2000 | Lowry | |
| 6,145,685 | A | 11/2000 | Dick | |
| 6,329,597 | B1 * | 12/2001 | Kaloustian | 174/67 |
| 6,474,494 | B1 * | 11/2002 | Miller | 220/379 |
| 7,318,574 | B2 | 1/2008 | Lee | |
| 7,845,505 | B2 | 12/2010 | Hamamoto | |
| 8,365,941 | B2 * | 2/2013 | Mayer | 220/259.3 |

* cited by examiner

*Primary Examiner* — Robert J Hicks
*Assistant Examiner* — Kareen Rush
(74) *Attorney, Agent, or Firm* — Roylance, Abrams, Berdo & Goodman, L.L.P.

(57) ABSTRACT

A storage container includes a jar and a cap removably connected to the jar. The jar has a cavity defined by a first base and a first wall extending upwardly from the base. The cap has an upper portion connected to a lower portion by a connecting member. The upper portion has a second base and a second wall extending upwardly from the second base to define a receiving area that receives an item stored in the cavity of the jar. The connecting member has an opening therethrough to connect the storage container to a support.

26 Claims, 11 Drawing Sheets

STORAGE CONTAINER FOR ELECTRICAL COMPONENTS

CROSS-REFERENCE TO RELATED APPLICATION

U.S. patent application Ser. No. 29/392,904, which is filed concurrently herewith, discloses related subject matter and is hereby incorporated by reference in its entirety.

FIELD OF THE INVENTION

The present invention relates to a storage container for conveniently storing and accessing components stored therein. More particularly, the present invention relates to a storage container having a cap removably connected to a jar in which the cap has an opening for hanging the storage container. Still more particularly, the present invention relates to a storage container having a cap removably connected to a jar such that the removed cap receives electrical components stored in the jar prior to use.

BACKGROUND OF THE INVENTION

Electric power transmission is the bulk transfer of electrical energy from generating power plants to substations located near population centers. Electricity distribution transmission is the wiring between the high voltage substations and customers. Electricians maintain electric power transmission and distribution facilities, and associated infrastructure related to distributing electricity to the customers.

The electrician often works in environments in which access to electrical components, such as electrical connectors, required for the job is restricted and difficult. Accordingly, a need exists for a storage container that conveniently stores and provides access to the electrical components stored therein.

Another problem encountered by an electrician is handling the electrical component prior to its use. The electrician generally holds the electrical component in his hand or mouth. Thus, the component can be easily dropped or lost. Additionally, by holding the electrical component in his hand, the electrician loses the ability to use that hand in performing the task. Accordingly, a need exists for a storage container that conveniently stores a component for quick and easy access.

SUMMARY OF THE INVENTION

Accordingly, it is a primary objective of the present invention to provide a storage container for electrical components.

A further objective of the present invention is to provide a storage container that provides quick and easy access to electrical components stored therein.

Another objective of the present invention is to provide a cap of a storage container that receives electrical components stored in the storage container.

Another objective of the present invention is to provide a cap of a storage container with an opening for connecting or mounting the storage container to a support.

The foregoing objectives are basically attained by a storage container having a jar and a cap removably connected to the jar. The jar has a cavity defined by a first base and a first wall extending upwardly from the first base. The cap has an upper portion connected to a lower portion by a connecting member. The upper portion has a second base and a second wall extending upwardly from the second base to define a receiving area to receive an item stored in the jar. The connecting member has an opening therethrough.

The foregoing objectives are also basically attained by a storage container for electrical components. A jar has a cavity to store the electrical components. A cap has an upper portion connected to a lower portion by a connecting member. The lower portion is removably connected to the jar and the upper portion is not connectable to the jar. The upper portion has a first receiving area and the lower portion has a second receiving area to receive the electrical components. An opening extends through the connecting member to receive a support.

The foregoing objectives are also basically attained by a method of temporarily storing electrical components stored in a storage container. A cap is removed from a jar of the storage container. The cap has an upper portion and a lower portion. The cap is positioned such that either the upper or lower portion is positioned on a support surface. At least one electrical component is removed from the jar and stored in the upper or lower portion of the cap not positioned on the support surface.

Other objects, advantages and salient features of the invention will become apparent from the following detailed description, which, taken in conjunction with the annexed drawings, discloses a preferred embodiment of the invention.

As used in this application, the terms "front," "rear," "upper," "lower," "upwardly," "downwardly," and other orientational descriptors are intended to facilitate the description of the high-voltage test terminal, and are not intended to limit the structure of the high voltage test terminal to any particular position or orientation.

BRIEF DESCRIPTION OF THE DRAWINGS

The above aspects and features of the present invention will be more apparent from the description for an exemplary embodiment of the present invention taken with reference to the accompanying drawings, in which.

Throughout the drawings, like reference numerals will be understood to refer to like parts, components and structures.

DETAILED DESCRIPTION OF EXEMPLARY EMBODIMENTS

Figure 1:
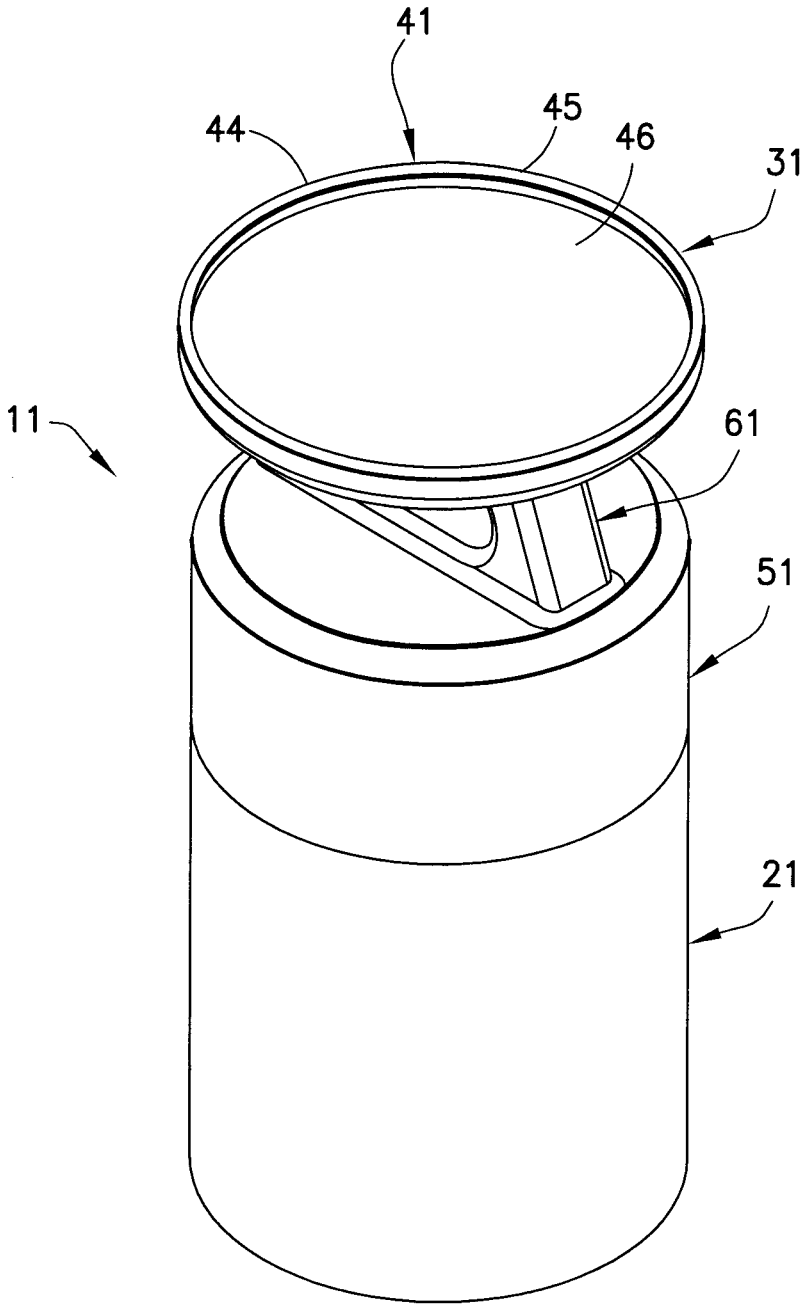
FIG. 1 is a perspective view of a storage container in accordance with an exemplary embodiment of the present invention.

As shown in FIGS. 1-20, a storage container 11 has a jar 21 and a cap 31 removably connected to the jar. The jar 21 has a cavity 23 defined by a first base 25 and a first wall 27 extending upwardly from the first base 25. The cap 31 has an upper portion 41 connected to a lower portion 51 by a connecting member 61. The upper portion 41 has a second base 43 and a second wall 45 extending upwardly from the second base 43 to define a receiving area 48 that receives an item stored in the cavity 23 of the jar 21. The connecting member 61 has an opening 63 therethrough. Accordingly, the storage container 11 conveniently stores electrical components 13 therein and provides quick and easy access thereto.

Figure 14:
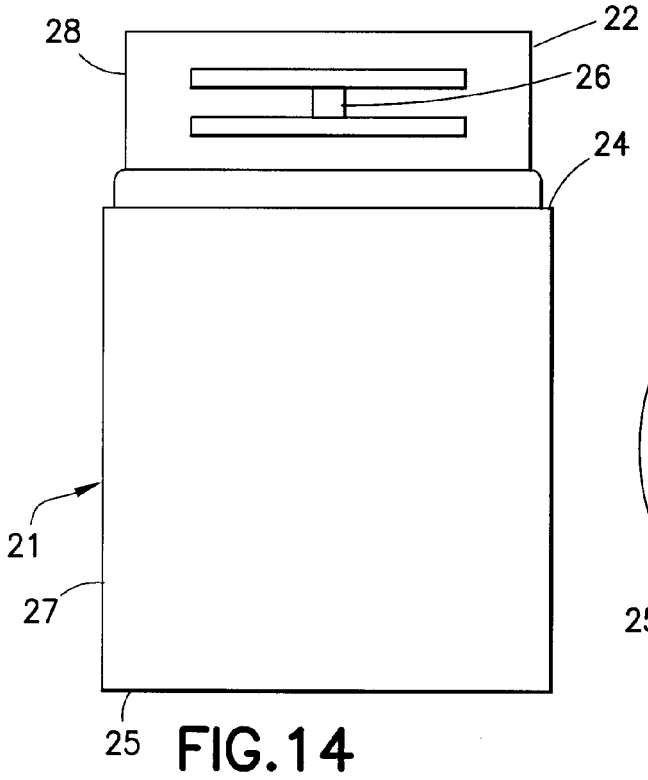
FIG. 14 is a side elevational view of the jar of FIG. 12.
Figure 16:
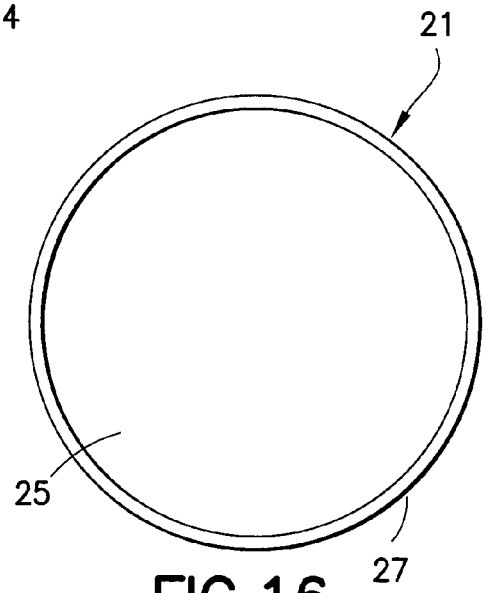
FIG. 16 is a bottom plan view of the jar of FIG. 7.
Figure 15:
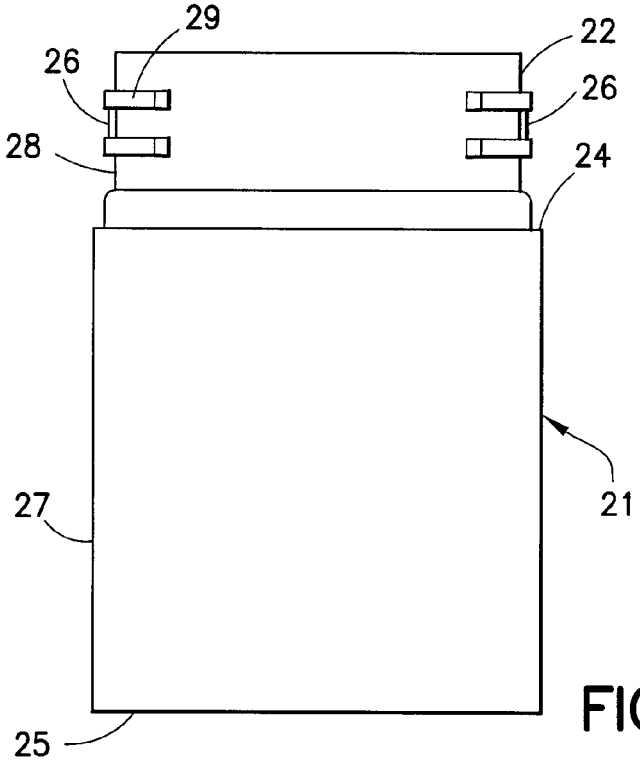
FIG. 15 is a front elevational view of the jar of FIG. 12.
Figure 18:
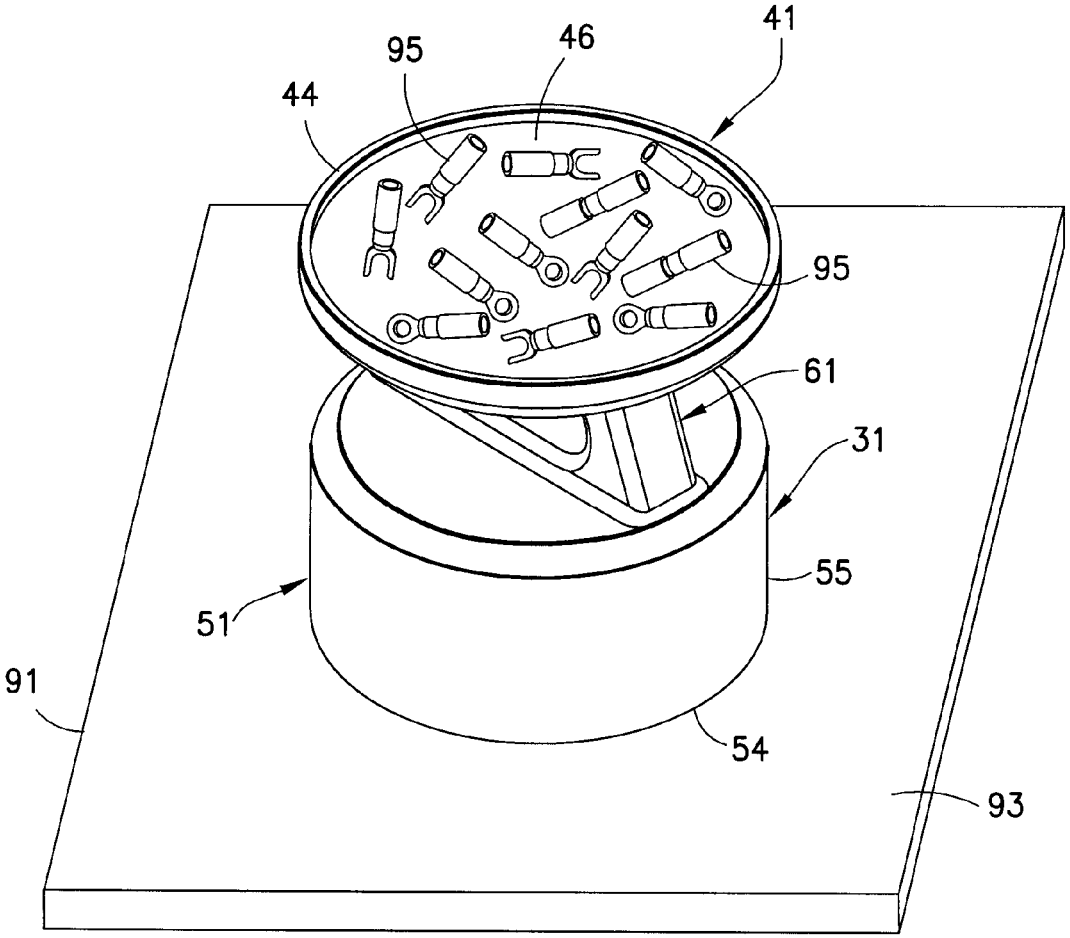
FIG. 18 is a perspective view of an upper portion of the cap receiving electrical components.

The jar 21 has a cavity 23 defined by a first base 25 and a first wall 27 extending upwardly from the first base, as shown in FIGS. 12-16. The base 25 of the jar 21 is preferably circular, as shown in FIG. 16. The first wall 27 has a reduced diameter portion 22, as shown in FIGS. 14 and 15, thereby forming a shoulder 24. An outer surface 28 of the first wall 27 has a first part 29 of a bayonet connection. An inner surface of the first base 25 is preferably substantially concave, as shown in FIGS. 1 and 18. Preferably, the first part 29 of the bayonet connection is formed on the outer surface 28 of the reduced diameter portion 22 of the jar 21. A tab or protrusion 26 is disposed in the first part 29 of the bayonet connection. A pair of protrusions 26 are preferably diametrically disposed, as shown in FIG. 15.

Figure 2:
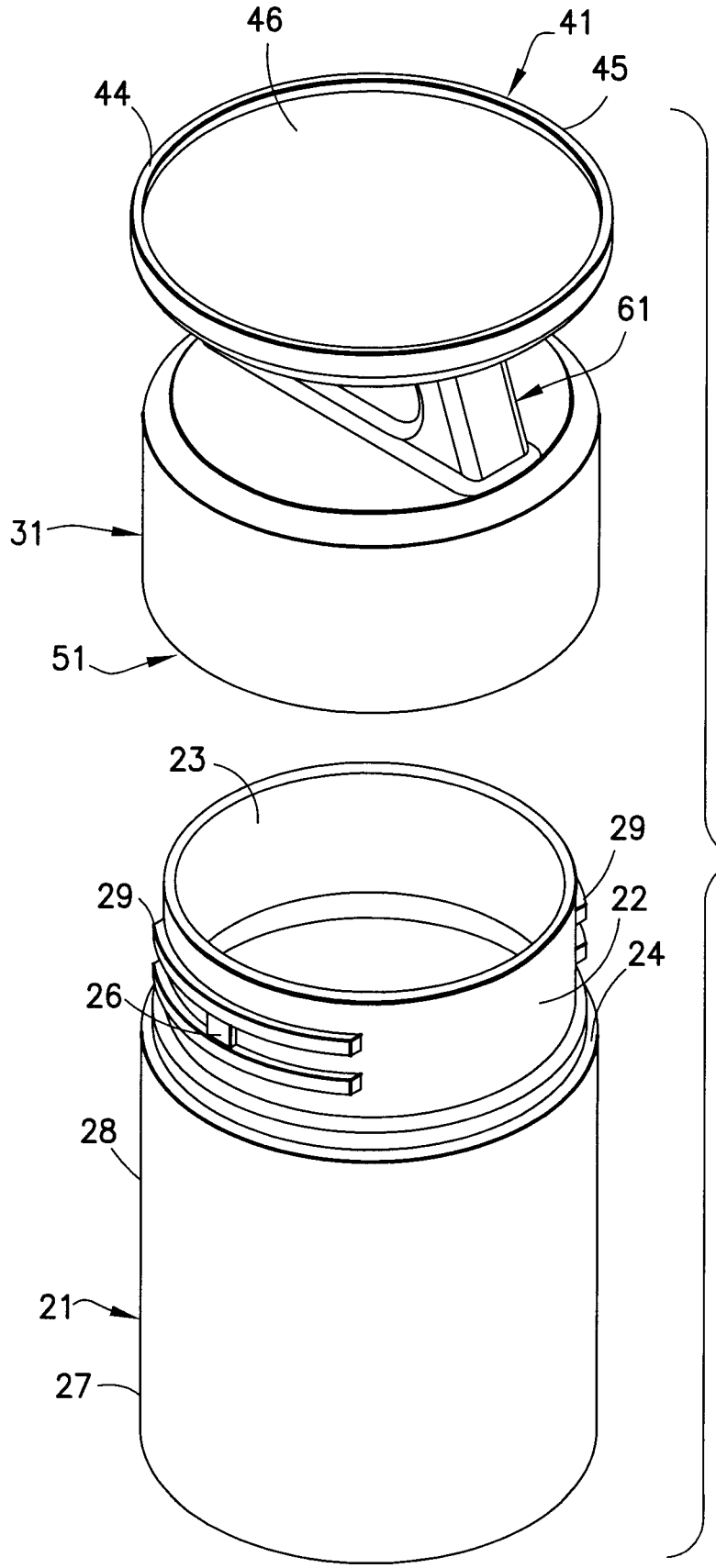
FIG. 2 is an exploded perspective view of the storage container of FIG. 1.
Figure 3:
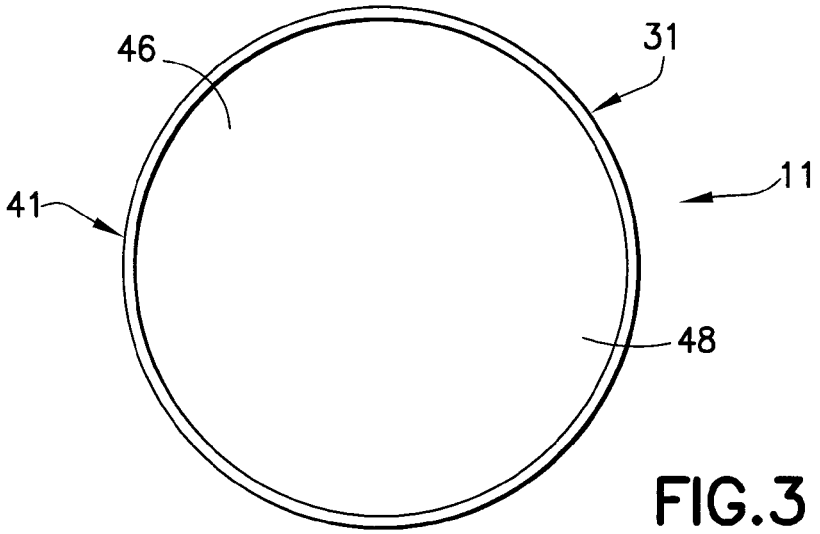
FIG. 3 is a top plan view of the storage container of FIG. 1.
Figure 19:
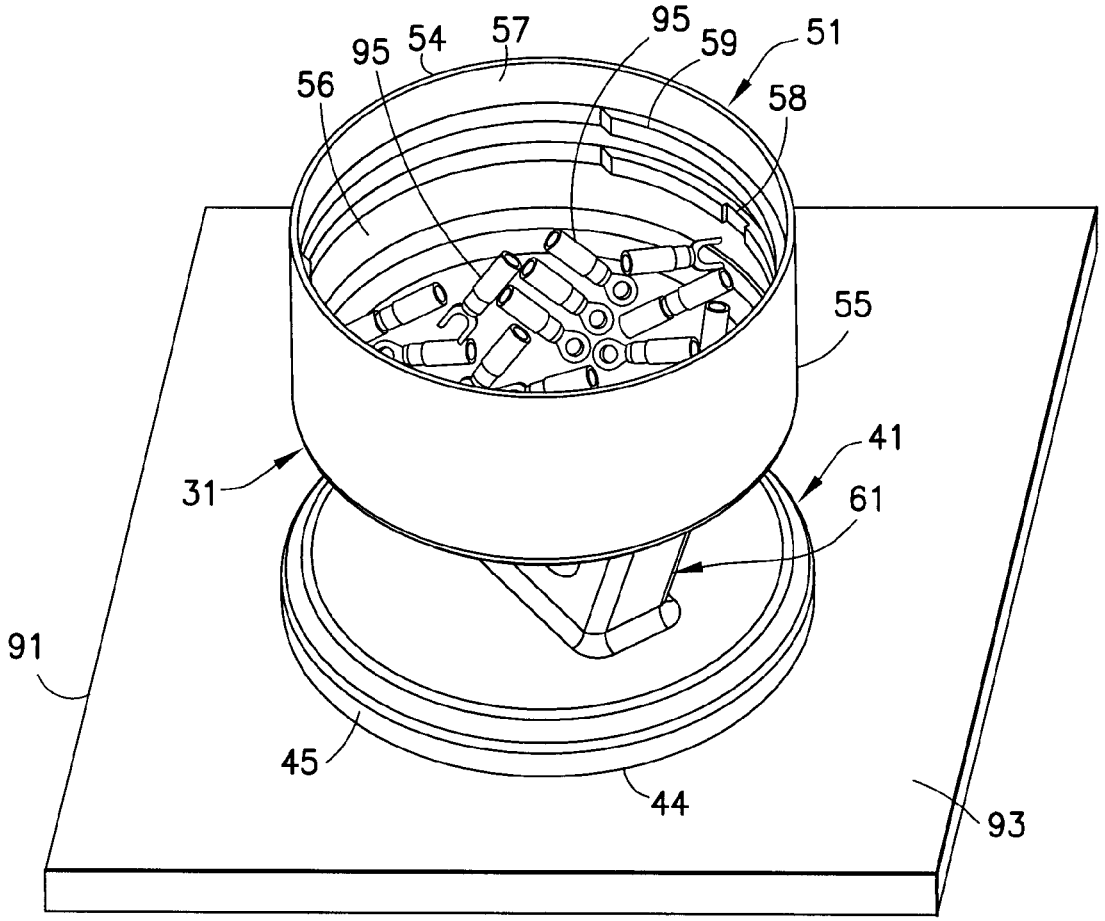
FIG. 19 is a perspective view of a lower portion of the cap receiving electrical components.

The cap 31 is removably connected to the jar 21, as shown in FIGS. 2, 18 and 19. The cap 31 has an upper portion 41 connected to a lower portion 51 by a connecting member 61, as shown in FIGS. 1, 2, 4 and 5.

Figure 7:
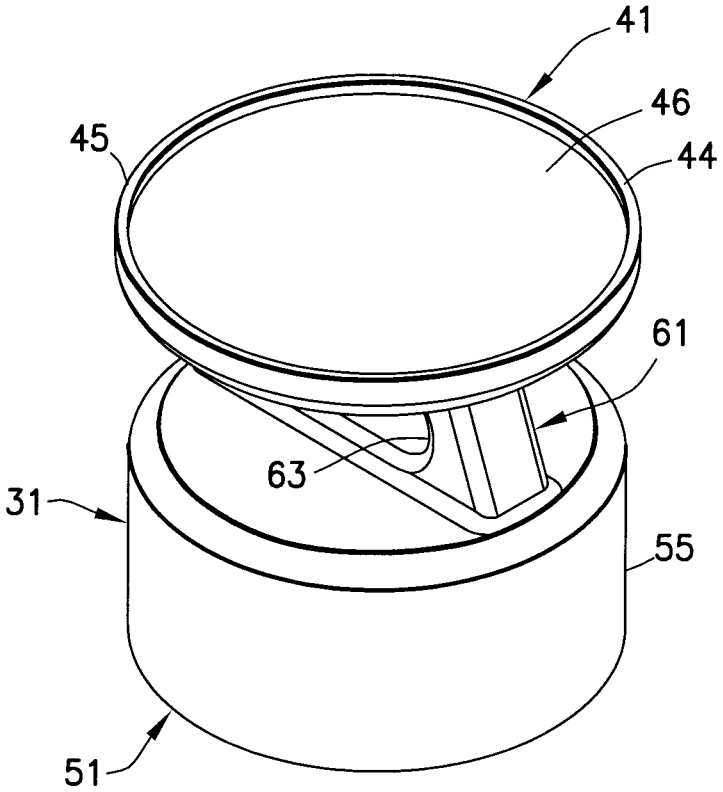
FIG. 7 is a perspective view of a cap of the storage container.
Figure 8:
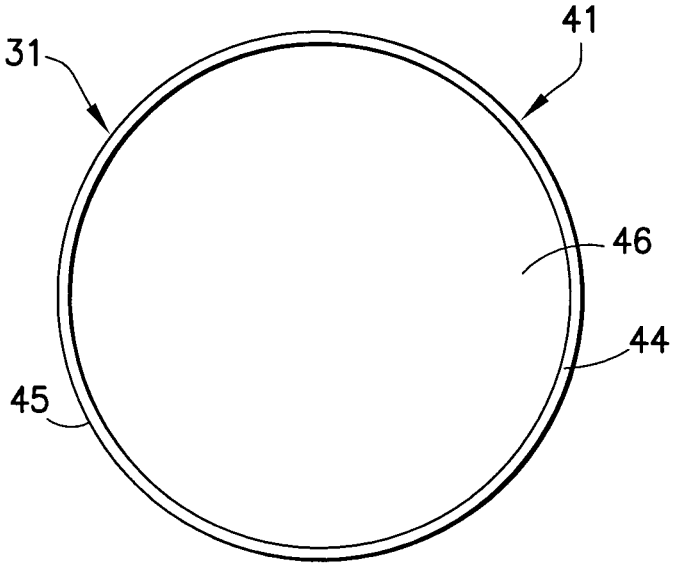
FIG. 8 is a top plan view of the cap of FIG. 7.
Figure 9:
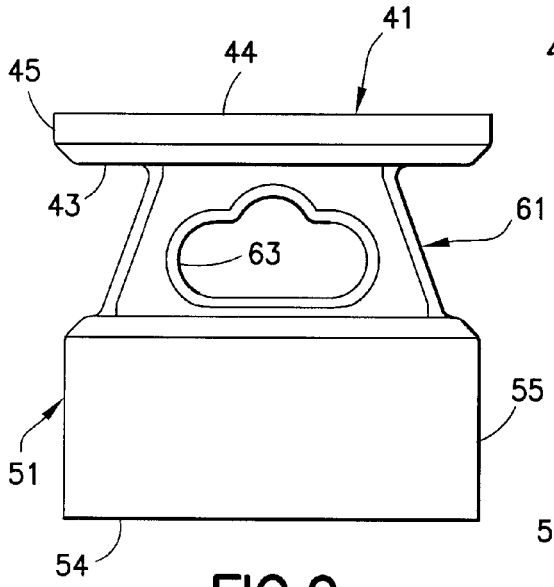
FIG. 9 is a side elevational view of the cap of FIG. 7.
Figure 10:
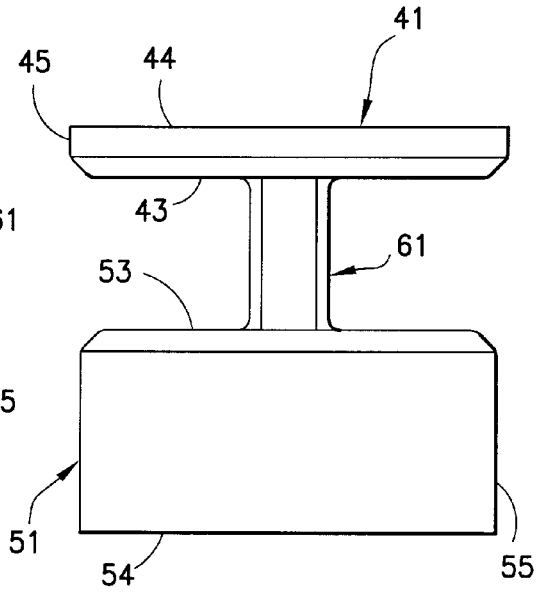
FIG. 10 is a front elevational view of the cap of FIG. 7.

The upper portion 41 of the cap 31 has a second base 43 and a second wall 45 extending upwardly from the second base to define a first receiving area 46, as shown in FIGS. 7 and 8. An inner surface 46 of the second base 43 is substantially planar, as shown in FIG. 1, to facilitate receiving electronic components stored in the cavity 23 of the jar 21. A free end 44 of the second wall 45 is substantially planar to facilitate positioning the cap 41 on the free end 44 of the second wall 45, as shown in FIGS. 9, 10 and 19.

Figure 4:
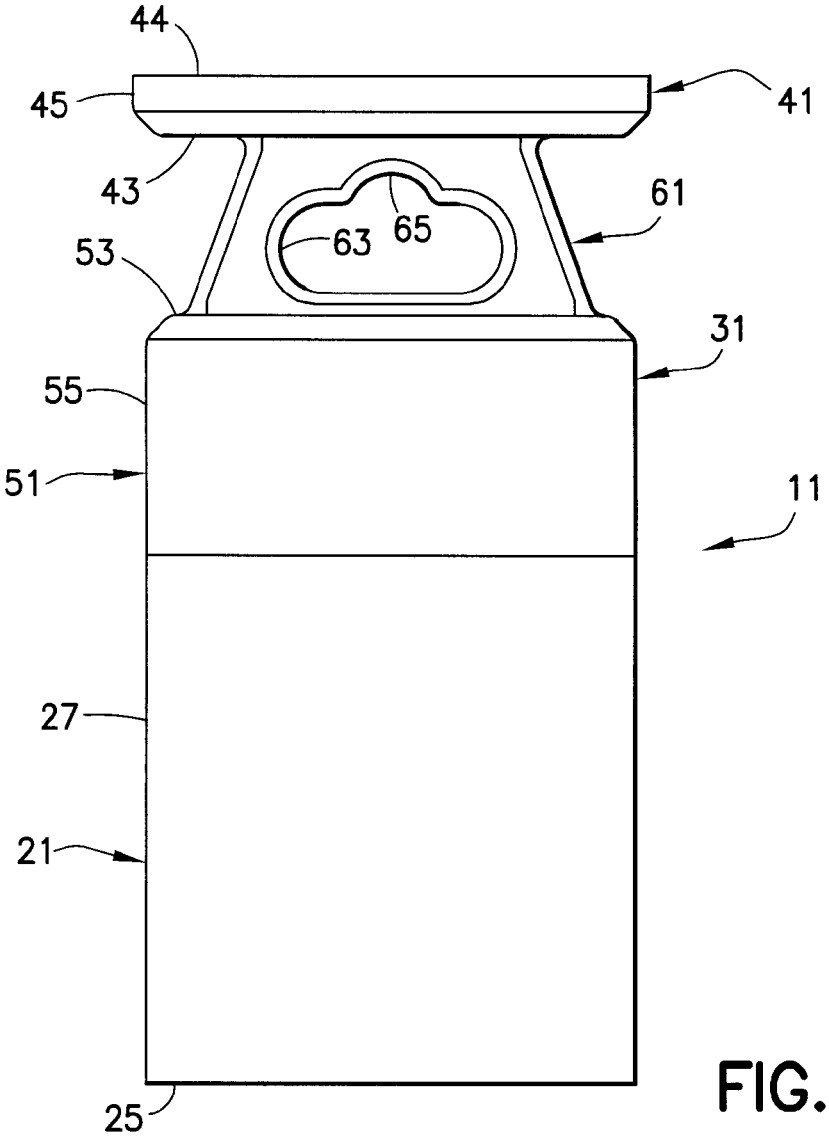
FIG. 4 is a side elevational view of the storage container of FIG. 11.
Figure 5:
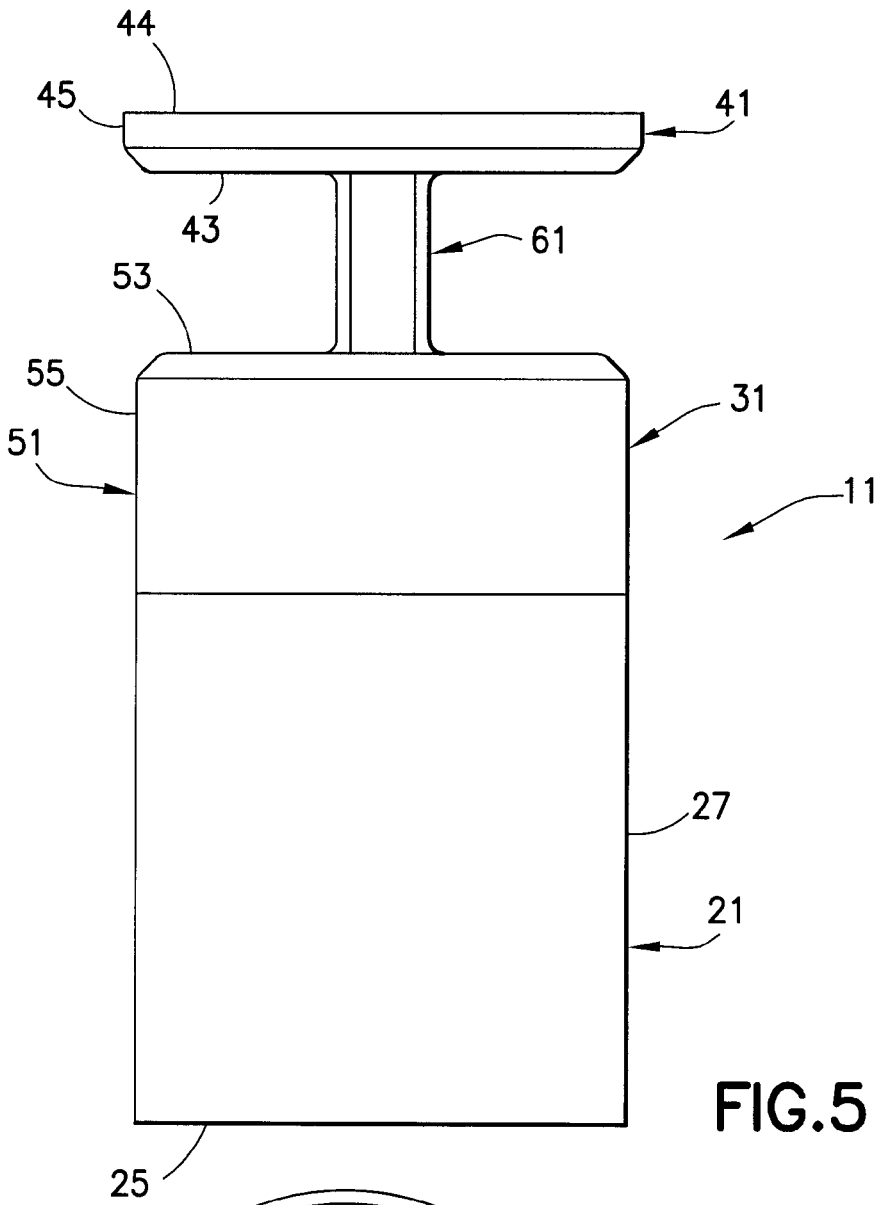
FIG. 5 is a front elevational view of the storage container of FIG. 1.
Figure 6:
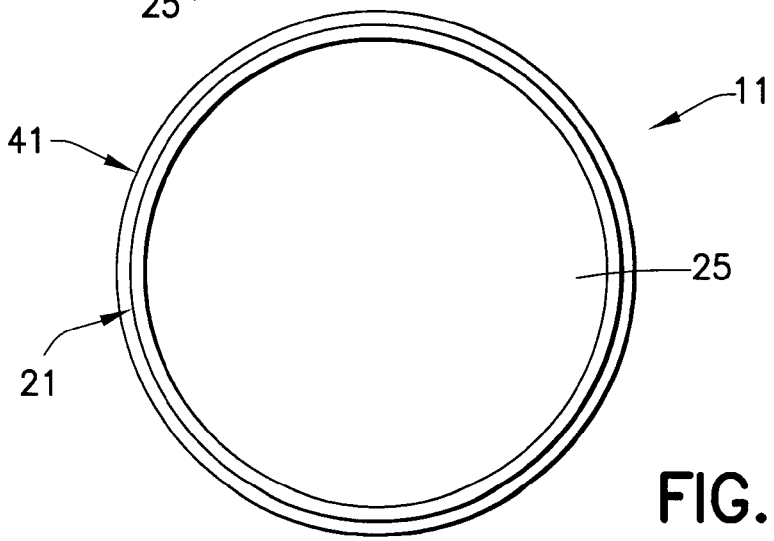
FIG. 6 is a bottom plan view of the storage container of FIG. 1.
Figure 11:
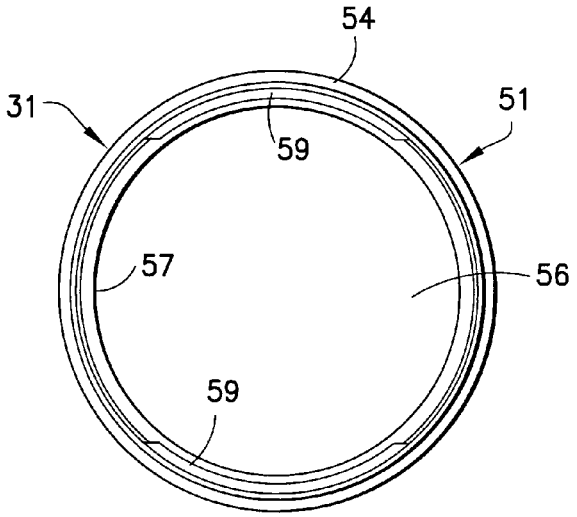
FIG. 11 is a bottom plan view of the cap of FIG. 7.
Figure 12:
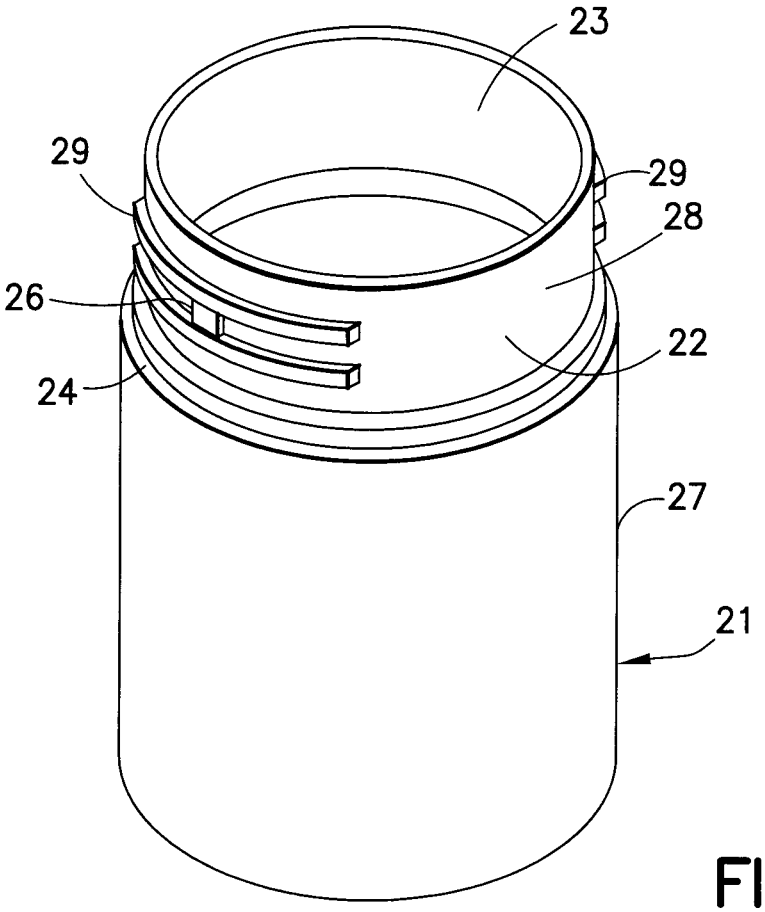
FIG. 12 is a perspective view of a jar of the storage container with the cap removed.
Figure 13:
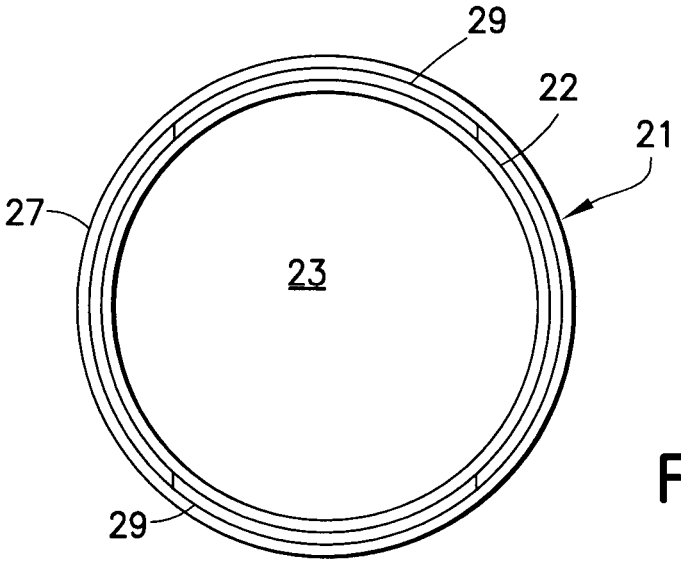
FIG. 13 is a top plan view of the jar of FIG. 12.

The lower portion 51 of the cap 31 has a third base 53 and a third wall 55 extending downwardly therefrom to define a second receiving area 56, as shown in FIGS. 11 and 19. The third wall 55 extends from the third base 53 in a direction substantially opposite to the direction in which the second wall 45 extends from the second base 43, as shown in FIGS. 4 and 5. A free end 54 of the third wall 55 is substantially planar to facilitate positioning the cap 51 on the free end 54 of the third wall 55, as shown in FIGS. 9, 10 and 18. An inner surface 57 of the lower portion 51 has a second part 59 of the bayonet connection, as shown in FIGS. 11 and 19. A detent or recess 58 is formed in the second part 59 of the bayonet connection, as shown in FIG. 19, to receive the protrusion 26 formed in the first part 29 of the bayonet connection of the jar 21 when connecting the cap to the jar. The cap 31 and/or jar 21 are resilient to facilitate engaging and disengaging of the protrusion 26 and the recess 58. The second receiving area 56 preferably has a larger volume than the first receiving area 48, as shown in FIGS. 9, 10, 18 and 19.

Figure 17:
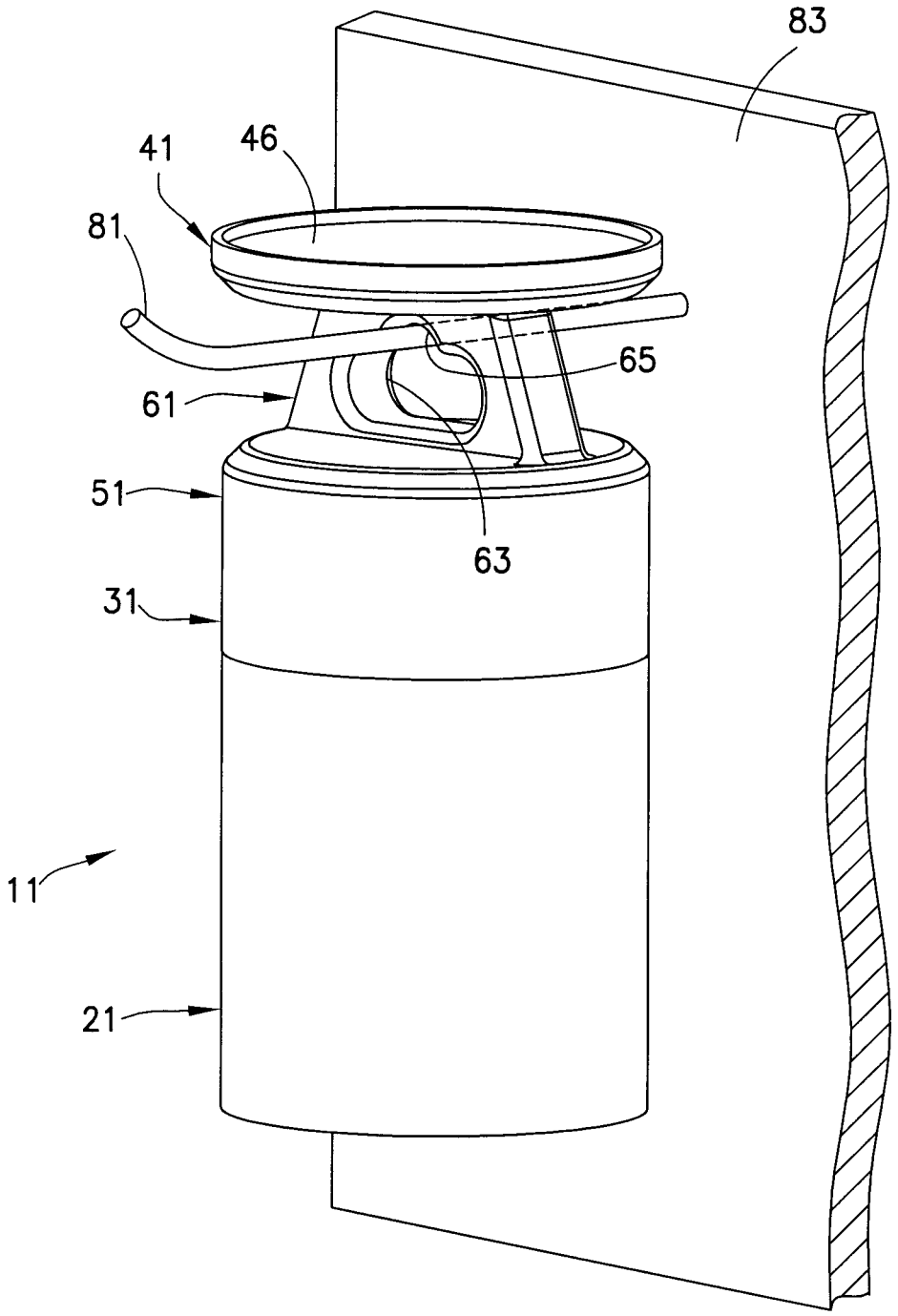
FIG. 17 is a perspective view of the storage container receiving or mounted on a support.

The connecting member 61 extends between the second base 43 of the upper portion 41 of the cap 31 and the third base 53 of the lower portion 51, as shown in FIGS. 1, 2, 4, 5, 9 and 10. An opening 63 extends through the connecting member, as shown in FIG. 4. The opening 63 has a substantially elliptical shape with a recess 65 formed in an upper portion of the opening to facilitate receiving a hook 81, as shown in FIGS. 4 and 17. The opening 63 preferably extends through the connecting member 61 in a direction substantially perpendicular to a longitudinal axis of the storage container 11.

Figure 20:
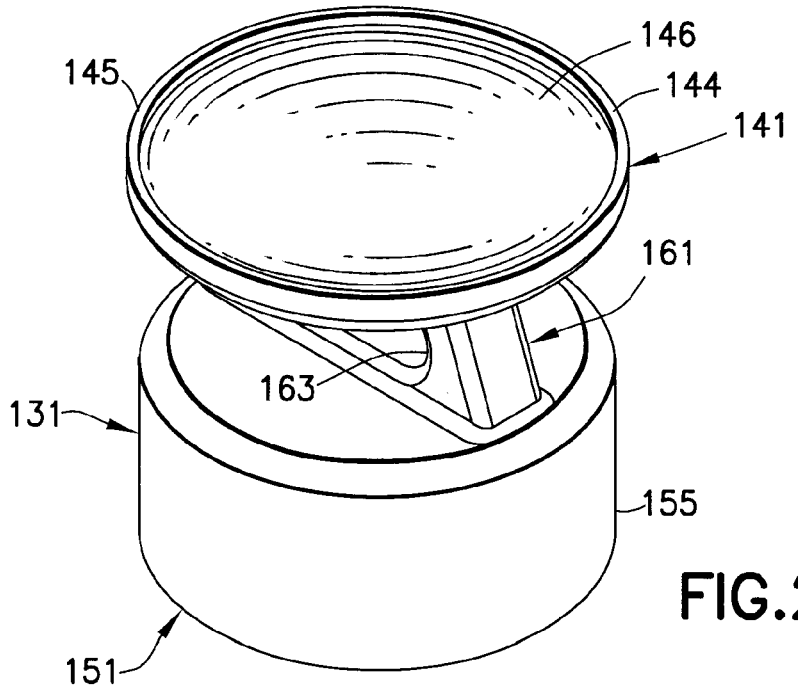
FIG. 20 is a perspective view of a cap in accordance with another exemplary embodiment in which an upper portion has a concave inner surface.

In an alternative embodiment shown in FIG. 20, the cap 131 has a first receiving area having a concave inner surface 146 to facilitate receiving electrical components. The remaining features of the cap 131 are substantially similar to the cap of FIG. 7 and use the same reference numeral in the 100 series.

The jar 21 and cap 31 of the storage container 11 are preferably made of polypropylene, although any suitable material may be used. The cap 31 and the jar 21 are each preferably unitarily formed or molded as one-piece members.

Assembly and Operation

The storage container 11 is shown completely assembled in FIGS. 1, 3-6 and 17, and disassembled in FIG. 2. The cap 31 is preferably connected to the jar 21 using a bayonet connection, but may be connected thereto in any suitable manner, such as with a threaded connection.

An outer surface 28 of the first wall has the second part 29 of the bayonet connection that receives the corresponding first part 59 of the bayonet connection of the lower portion 51 of the cap 31, as shown in FIGS. 11 and 19. To close the storage container 11, the cap 31 is positioned with respect to the jar 21 such that the free end 54 of the lower portion 51 abuts the shoulder 24 of the jar, as shown in FIG. 1. The cap 31 is then rotated approximately a quarter turn such that the first and second bayonet parts 59 and 29 guide the protrusions 26 into the corresponding recesses 58. Preferably, the upper portion 41 of the cap 31 does not have a corresponding bayonet part. The protrusions 26 engage the corresponding recesses 58 to secure the cap 31 to the jar 21. Electrical components, such as the electrical connectors 95 shown in FIGS. 18 and 19, can be stored in the storage container 11. To access the electrical connectors 95 stored in the cavity 23 of the jar 21, the cap 31 is rotated to disengage the protrusions 26 from the recesses 58. After rotating the cap approximately a quarter turn in either direction, the first and second bayonet parts are disengaged such that the cap 31 can be removed from the jar 21.

The storage container 11 can be stored by hanging the storage container on a hook 81 connected to a support, such as a wall 83, as shown in FIG. 17. The hook 81 is received by the recessed portion 65 of the opening 63 to facilitate hanging the storage container 11 on the hook 81 in addition to substantially preventing movement of the connecting member 61 along the hook.

After removing the cap 31 from the jar 21, the electrician can remove a few of the electrical connectors 95 from the jar cavity 23 and temporarily store them in the first receiving area 48 of the upper portion 41 of the cap 31 as shown in FIG. 18 or in the second receiving area 56 of the lower portion 51 of the cap 31 as shown in FIG. 19.

The free end 54 of the third wall 55 of the lower portion 51 of the cap 31 is substantially planar so that the lower portion of the cap can positioned on a substantially planar surface 93 of a support 91, such as a table or floor, as shown in FIG. 18. The first receiving area 48 is easily accessible by the electrician so that there is no need for the electrician to hold the needed electrical connectors in his hand or mouth.

Alternatively, the cap 31 can be positioned such that the second receiving area 56 is readily accessible, as shown in FIG. 19. The free end 44 of the second wall 45 of the upper portion 41 of the cap 31 is substantially planar so that the upper portion of the cap can positioned on the substantially planar surface 93 of the support 91, such as a table or floor, as shown in FIG. 19. The second receiving area 56 is easily accessible by the electrician so that there is no need for the electrician to hold the needed electrical connectors in his hand or mouth.

When the electrician's work has been completed, the unused electrical connectors 95 can be returned to the jar cavity 23. The cap 31 is then connected to the jar 21 to close the storage container 11, which can be hung on a hook 81 as shown in FIG. 17 for storage.

While advantageous embodiments have been chosen to illustrate the invention, it will be understood by those skilled in the art that various changes and modifications may be made therein without departing from the scope of the invention as defined in the appended claims.

What is claimed is:

1. A storage container, comprising:

a jar having a storage cavity defined by a first base and a first wall extending upwardly from said first base;

a cap removably connected to said jar, said cap having an upper portion connected to a lower portion by a connecting member extending along a longitudinal axis between said upper and lower portions;

said upper portion having a second base and a second wall extending upwardly from said second base to define a first receiving area configured to receive and support at least one item removed from said cavity of said jar; and an opening extending through said connecting member in a direction substantially perpendicular to said longitudinal axis to receive a support therein, said opening being accessible by the support when said cap is connected to said jar.

2. The storage container of claim 1, wherein said second base has a concave upper surface.

3. The storage container of claim 1, wherein said lower portion of said cap has a third base and a third wall extending downwardly therefrom to define a second receiving area adapted to receive an item stored in said cavity of said jar.

4. The storage container of claim 3, wherein an outer surface of said first wall and an inner surface of said third wall have corresponding first and second bayonet parts to facilitate connecting said cap to said jar.

5. The storage container of claim 3, wherein said third wall extends in a direction substantially opposite to said second wall.

6. The storage container of claim 1, wherein a free end of said second wall is substantially planar to facilitate positioning said cap on said free end of said second wall.

7. The storage container of claim 3, wherein a free end of said third wall is substantially planar to facilitate positioning said cap on said free end of said third wall.

8. The storage container of claim 4, wherein a protrusion is disposed in said first bayonet part in said jar and a corresponding recess is disposed in said second bayonet part in said cap to facilitate securing said cap to said jar.

9. The storage container of claim 1, wherein said upper portion of said cap does not have a bayonet part.

10. The storage container of claim 3, wherein said second receiving area having a larger volume than said first receiving area.

11. A storage container for electrical components, comprising:

a jar having a cavity to store the electrical components;

a cap having an upper portion connected to a lower portion by a connecting member extending along a longitudinal axis between said upper and lower portions, said lower portion being removably connected to said jar;

said upper portion having a first receiving area and said lower portion having a second receiving area, said first and second receiving areas configured to receive and support at least one of the electrical components when said cap is removed from said jar; and an opening extending through said connecting member in a direction substantially perpendicular to said longitudinal axis to receive a support therein, said opening being accessible by a support when said cap is connected to said jar.

12. The storage container of claim 11, wherein said upper portion has a second base and a second wall extending upwardly from said second base to define said first receiving area.

13. The storage container of claim 12, wherein said second base has a concave upper surface.

14. The storage container of claim 13, wherein said lower portion of said cap has a third base and a third wall extending downwardly therefrom to define said second receiving area.

15. The storage container of claim 14, wherein an outer surface of said jar and an inner surface of said third wall have corresponding first and second bayonet parts to facilitate connecting said cap to said jar.

16. The storage container of claim 15, wherein a protrusion is disposed in said second bayonet part of said jar and a corresponding recess is disposed in said first bayonet part of said cap to facilitate securing said cap to said jar.

17. The storage container of claim 15, wherein free ends of said second and third walls are substantially planar, respectively, to facilitate positioning either said upper or lower portion of said cap on a support surface.

18. A method of temporarily storing electrical components stored in a storage container, comprising the steps of completely removing a cap from a jar of the storage container, the cap having an upper portion and a lower portion;

positioning the cap such that either the upper or lower portion is positioned on a support surface separate from the jar;

completely removing at least one whole electrical component from the jar; and loosely storing the at least one removed whole electrical component entirely in the upper or lower portion not positioned on the support surface.

19. The method of temporarily storing electrical components stored in a storage container of claim 18, further comprising reconnecting the cap to the jar; and passing a hook through an opening in the cap of the storage container to hang the storage container while not in use.

20. The storage container of claim 1, wherein said cap is unitarily formed as a one-piece member.

21. The storage container of claim 11, wherein said cap is unitarily formed as a one-piece member.

22. A storage container, comprising:

a jar having a cavity defined by a first base and a first wall extending upwardly from said first base;

a cap removably connected to said jar, said cap having an upper portion connected to a lower portion by a connecting member;

said upper portion having a second base and a second wall extending upwardly from said second base to define a first receiving area adapted to receive an item stored in said cavity of said jar;

an opening extending through said connecting member to receive a support;

said lower portion of said cap having a third base and a third wall extending downwardly therefrom to define a second receiving area adapted to receive an item stored in said cavity of said jar; and an outer surface of said first wall and an inner surface of said third wall having corresponding first and second bayonet parts to facilitate connecting said cap to said jar.

23. A storage container for electrical components, comprising:

a jar having a cavity to store the electrical components;

a cap having an upper portion connected to a lower portion by a connecting member, said lower portion being removably connected to said jar;

said upper portion having a first receiving area and said lower portion having a second receiving area to receive the electrical components when said cap is removed from said jar; and an opening extending through said connecting member to receive a support;

said upper portion having a second base and a second wall extending upwardly from said second base to define said first receiving area, said second base having a concave upper surface;

said lower portion of said cap having a third base and a third wall extending downwardly therefrom to define said second receiving area; and an outer surface of said jar and an inner surface of said third wall having corresponding first and second bayonet parts to facilitate connecting said cap to said jar.

24. A storage container, comprising:

a jar having a storage cavity defined by a first base and a first wall extending upwardly from said first base;

a cap removably connected to said jar, said cap having an upper portion connected to a lower portion by a longitudinally extending connecting member;

said upper portion having a second base and a second wall extending upwardly from said second base to define a first receiving area configured to receive and support at least one item removed from said cavity of said jar; and an opening extending transversely through said connecting member to receive a support therein, said opening being accessible by a support when said cap is connected to said jar.

25. The storage container of claim 24, wherein said cap is unitarily formed as a one-piece member.

26. The storage container of claim 24, wherein said second base has a concave surface for supporting the at least one item.

* * * * *